United States Patent [19]

Herbst et al.

[11] 4,311,183

[45] Jan. 19, 1982

[54] COMBINATION STORM AND SCREEN SELF STORING DOOR

[76] Inventors: Walter Herbst, 86 Salem La., Cook County, Evanston, Ill. 60203; Robert A. Pascal, 1350 Forest, Lake County, Highland Park, Ill. 60035

[21] Appl. No.: 949,146

[22] Filed: Oct. 6, 1978

Related U.S. Application Data

[63] Continuation-in-part of Ser. No. 652,126, Jan. 26, 1976, abandoned, and a continuation-in-part of Ser. No. 770,080, Feb. 18, 1977, abandoned.

[51] Int. Cl.[3] ..... E06B 9/00

[52] U.S. Cl. ..... 160/37; 160/90; 49/450; 49/501; 52/223 R; 52/455; 52/582

[58] Field of Search ..... 160/37, 90, 92; 49/48, 49/125, 207, 327, 63, 450, 485, 495, 501, 503; 52/223 R, 316, 455, 573, 582, 619, 656

[56] References Cited

U.S. PATENT DOCUMENTS

| | | | |
|---|---|---|---|
| 1,207,885 | 12/1916 | Estabrook | 160/37 |
| 2,540,864 | 2/1951 | Carter | 160/37 |
| 2,559,764 | 7/1951 | Goldberg | 49/485 |
| 2,659,461 | 11/1953 | Bowman | 52/619 |
| 2,700,195 | 1/1955 | Heidorn | 52/223 R |
| 2,867,857 | 1/1959 | McCarthy | 52/582 |
| 2,927,354 | 3/1960 | Lauer | 49/501 |
| 3,080,620 | 3/1963 | Mendelsohn | 160/90 |
| 3,083,419 | 4/1963 | Pennington et al. | 160/90 |
| 3,122,797 | 3/1964 | Segre | 49/450 |
| 3,177,924 | 4/1965 | McPhail | 49/63 |
| 3,287,856 | 11/1966 | Passovoy | 49/495 |
| 3,389,505 | 6/1968 | Zitomer | 52/455 |
| 3,760,543 | 9/1973 | McAllister | 52/455 |
| 3,878,649 | 4/1975 | Mennuto | 49/501 |
| 3,985,175 | 10/1976 | Pukl | 49/501 |

*Primary Examiner*—Philip C. Kannan
*Attorney, Agent, or Firm*—Jack E. Dominik

[57] ABSTRACT

A combination storm and screen door is disclosed comprising an outer and inner frame, each having the entire configuration of a door, and is composed of totally integral molded plastic. Disposed between the frames along the lateral sides and bottom and top of the door are steel reinforcement beams. The upper portion of the door has an opening and the lower portion has a storage cavity, both defined by the outer and inner frames. A storm window and a screen are slidingly positioned within the door to be lowered within the storage cavity when not in use, and to be raised to the opening when in use. Both the window and screen may be removed for cleaning, repair, or replacement. The outer and inner frames are molded, preferably from a blown or porous insulated type plastic material. Weather stripping is provided and other insulation characteristics are included in the door.

27 Claims, 30 Drawing Figures

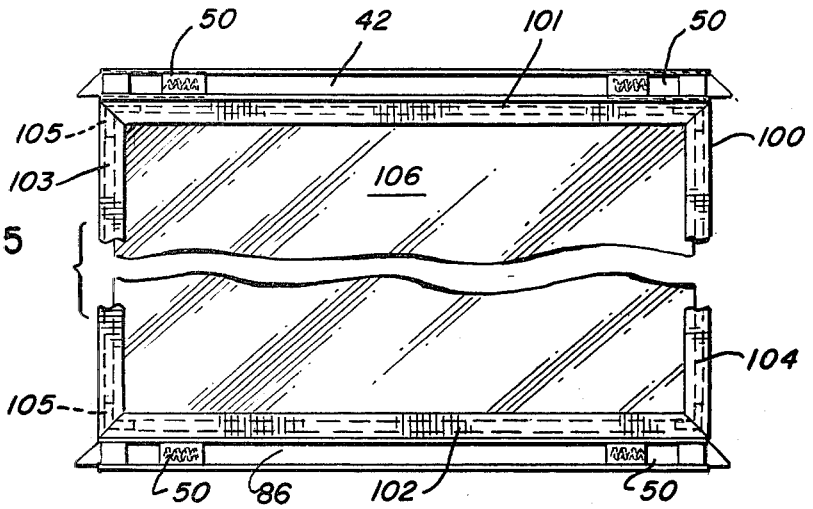
FIG. 5
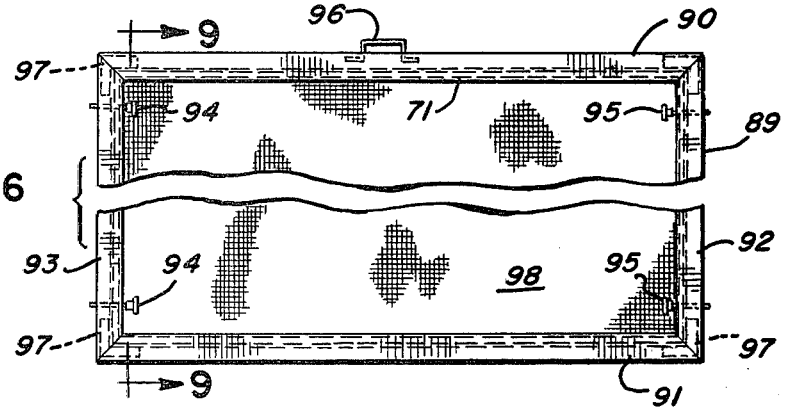
FIG. 6
FIG. 9
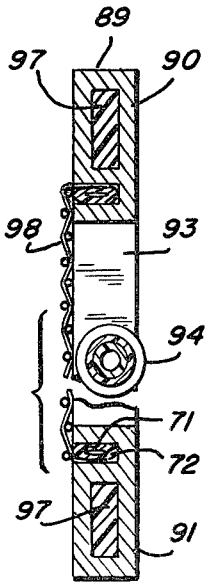
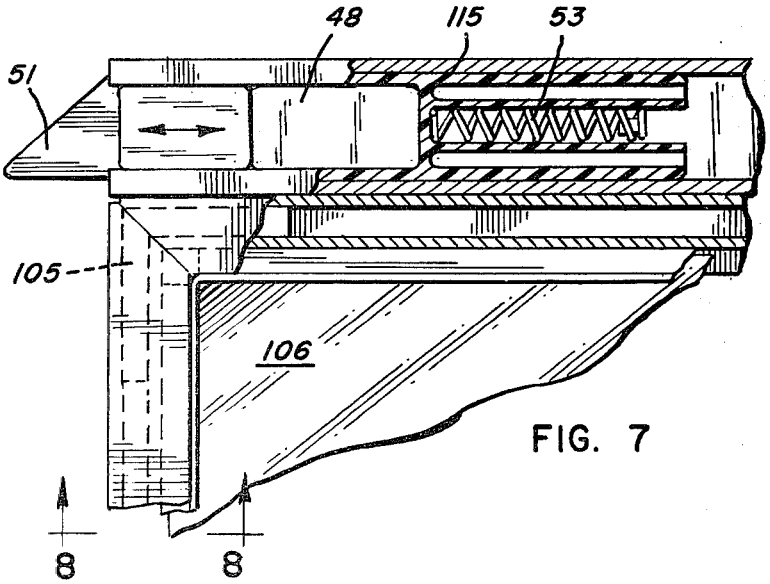
FIG. 7
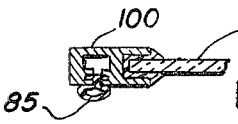
FIG. 8

FIG. 15
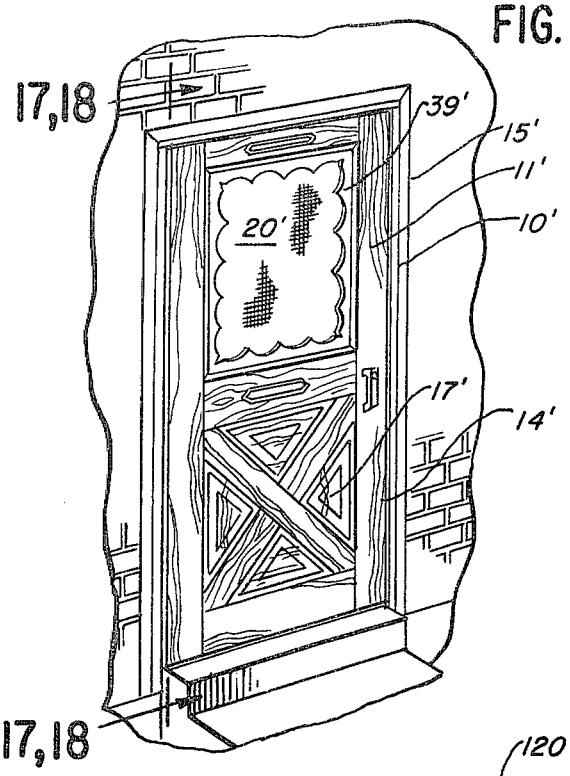
FIG. 17
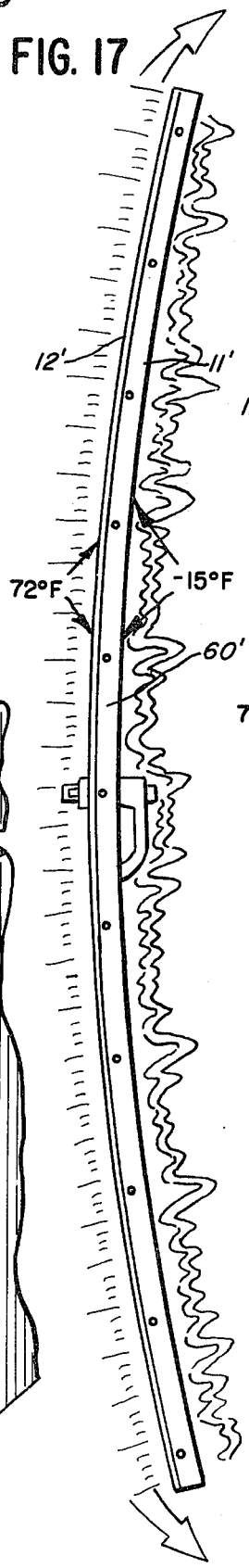
FIG. 18
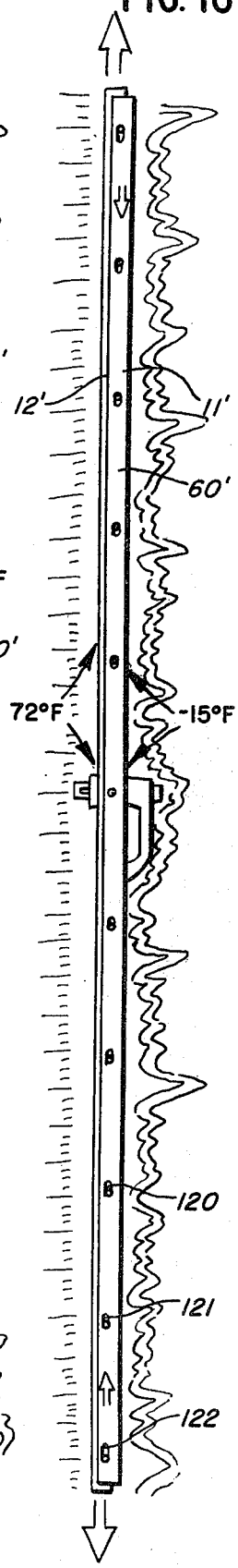
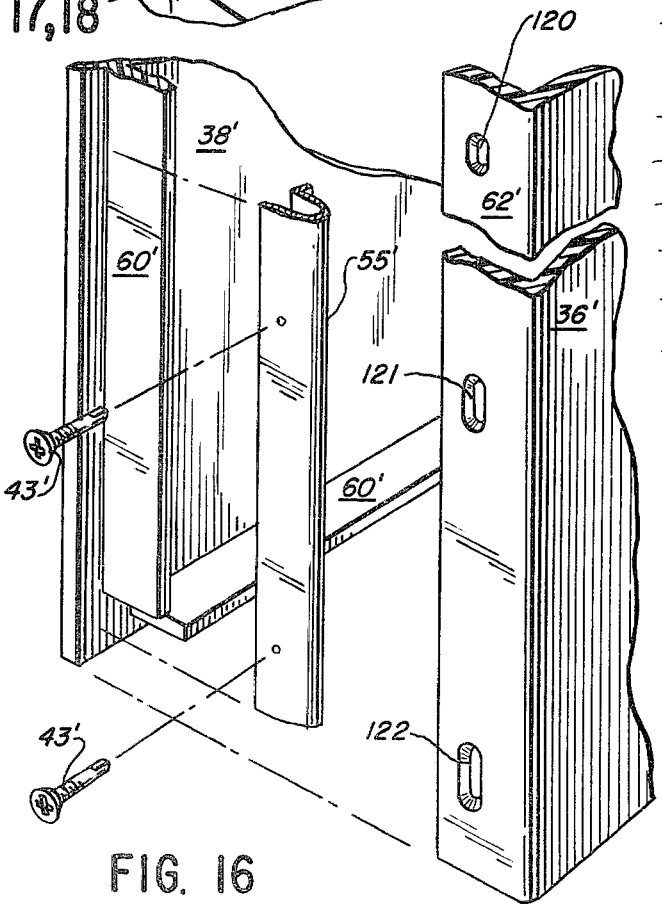
FIG. 16

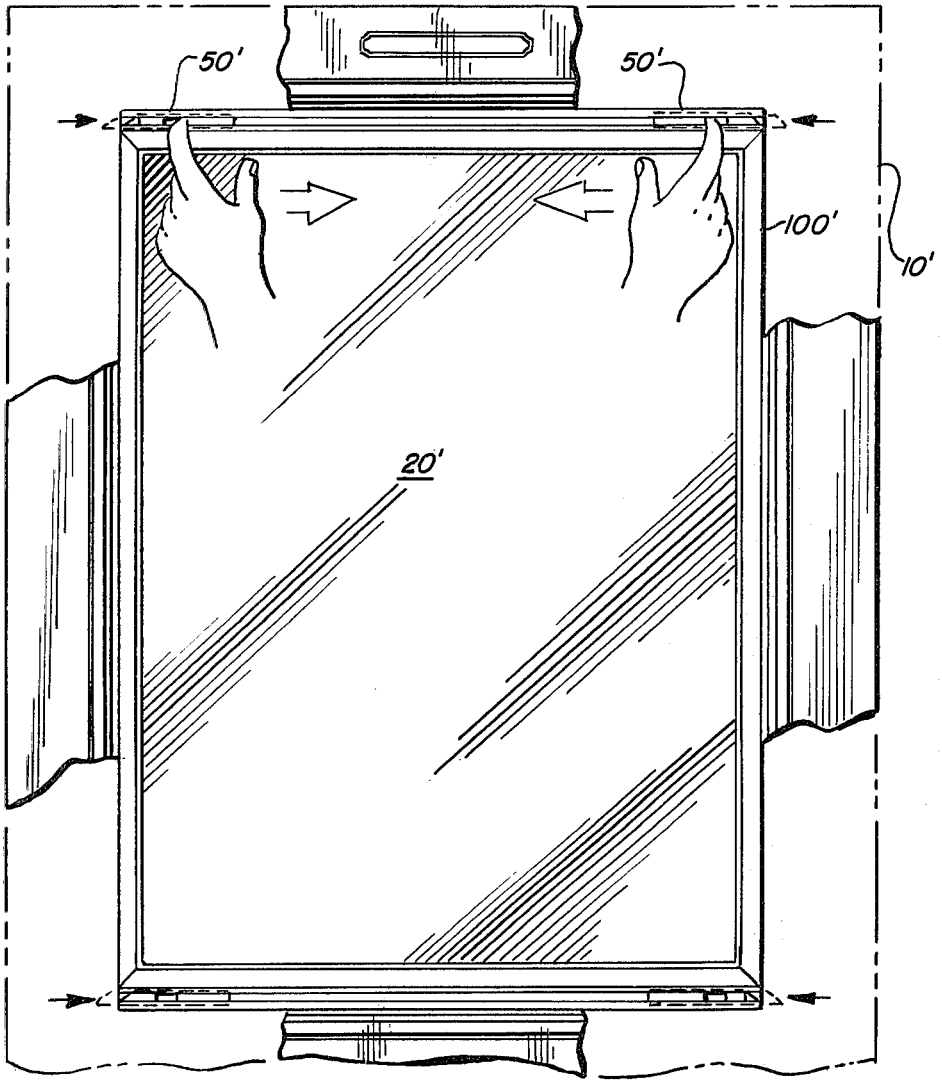
FIG. 19
FIG. 20
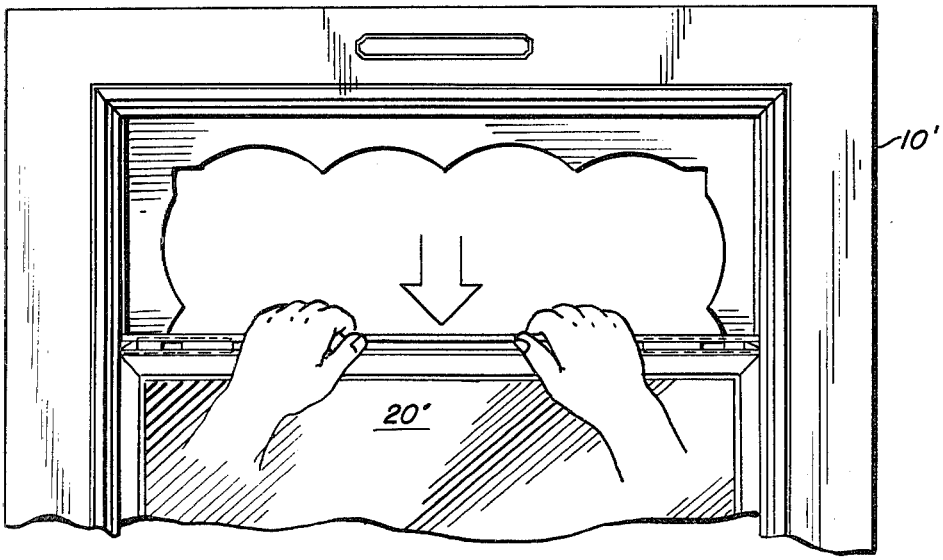

FIG. 21
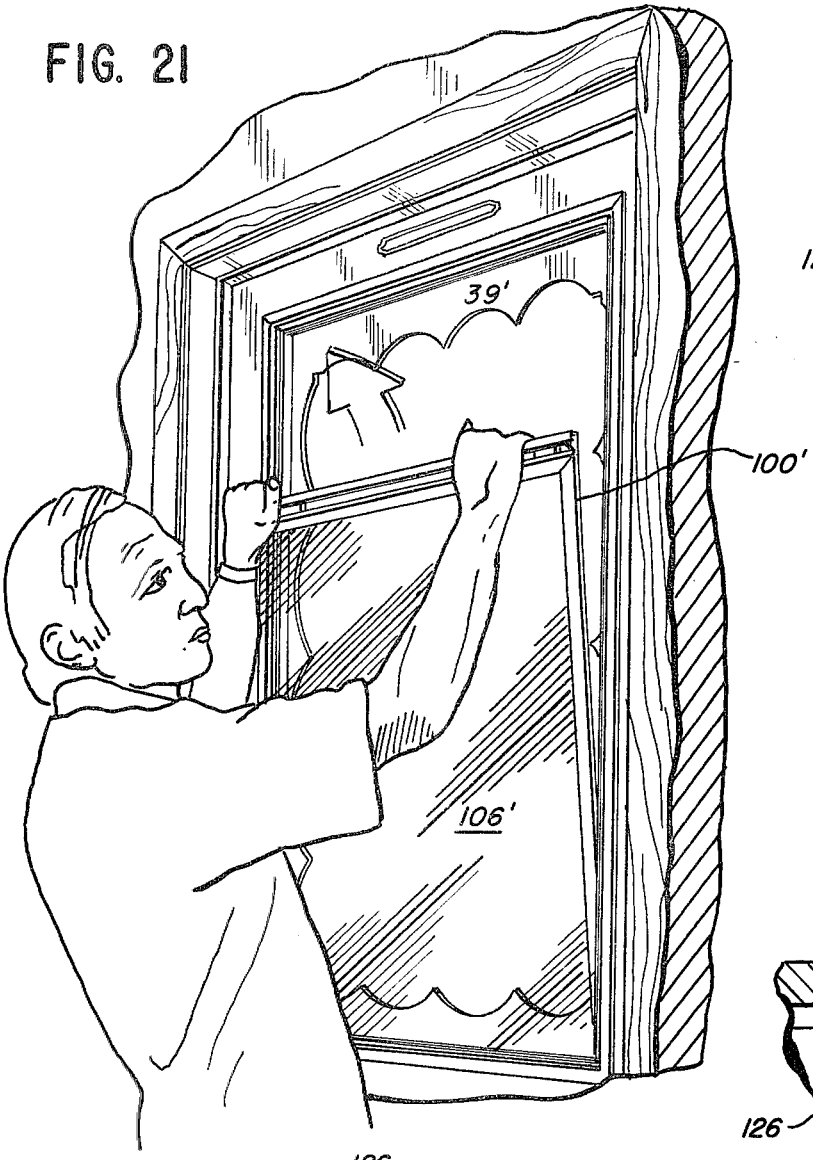
FIG. 24
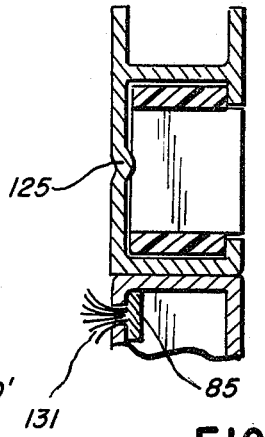
FIG. 25
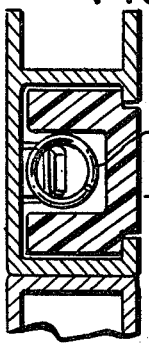
FIG. 26
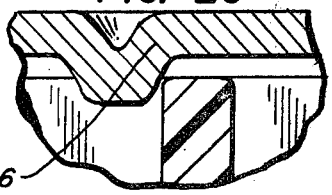
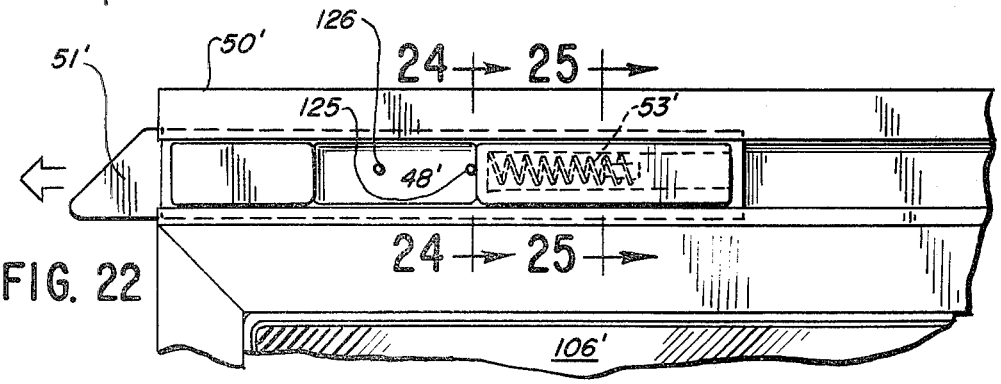
FIG. 22
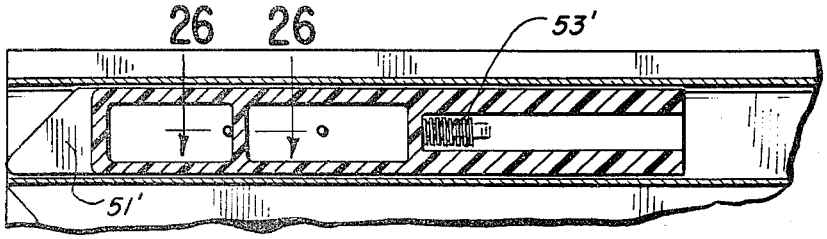
FIG. 23

FIG. 27
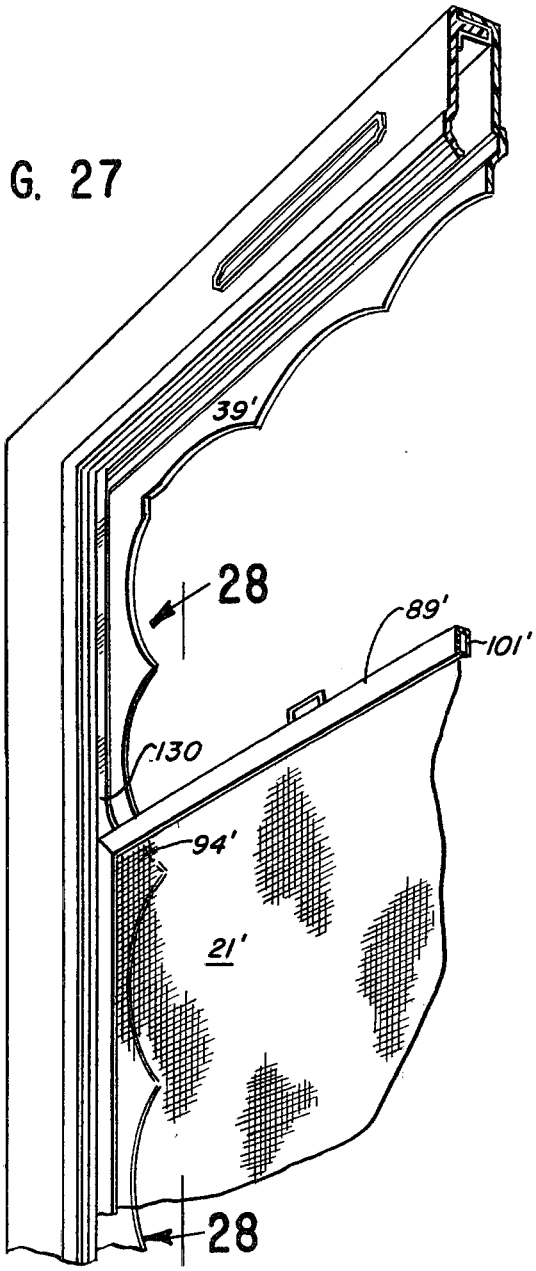
FIG. 28
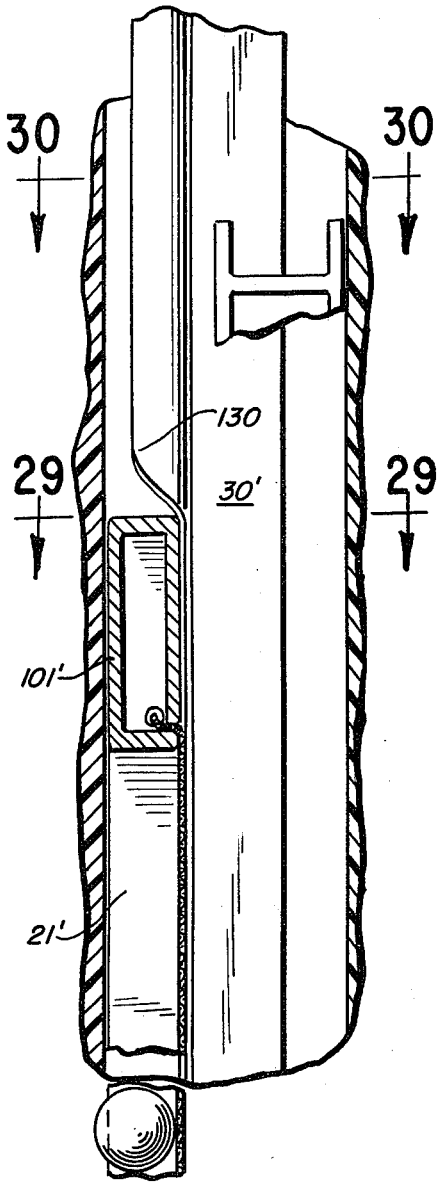
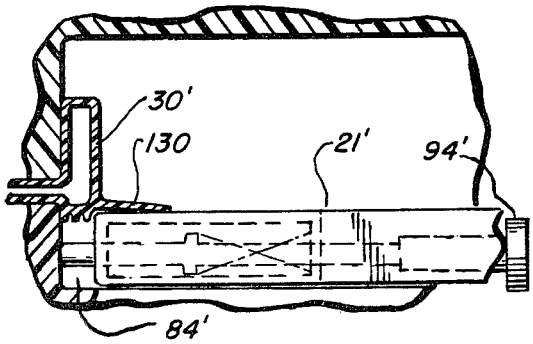
FIG. 29
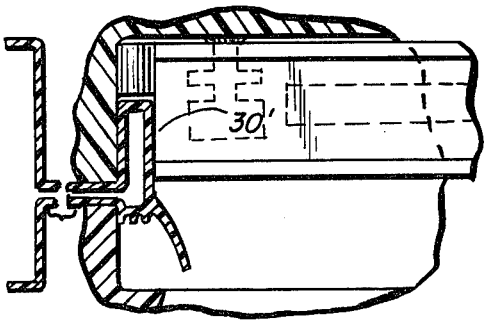
FIG. 30

COMBINATION STORM AND SCREEN SELF STORING DOOR

RELATED APPLICATIONS

This is a continuation in part application Ser. No: 652,126, filed Jan. 26, 1976, now abandoned, and Ser. No. 770,080, filed Feb. 18, 1977, now abandoned.

FIELD OF THE INVENTION

The present invention relates to combination doors, and particularly that type which self-store a storm window and screen. In addition, it is suitably molded from a plastic material.

Description of the Prior Art

The prior art is best illustrated by U.S. Pat. No. 1,207,885. The inherent problem in the door disclosed in this patent is that the screen and window can only be removed for cleaning or replacement by removing the panels. Additionally, sufficient insulation characteristics are not disclosed by this device. Also, there is no teaching as to how totally integral molded plastic halves with their appropriate reinforcements can be utilized to create an efficient and well-insulated combination storm and screen door. Furthermore, no safety features are provided for preventing damage of the window when it is inadvertently dropped.

The prior art is also illustrated in U.S. Pat. Nos. such as 3,404,502, showing a decorative hollow door; 3,100,917, showing a molded plastic frame construction; and 2,980,217 showing a metal door construction. U.S. Pat. No. 1,207,885 discloses a combination door. The same are classified variously in the Patent Office Classification files. Most metal storm doors have a provision for exchanging the storm window with the screen, but not storing the same within the door. In addition, metal doors have an insulating factor which is almost negligible, and in addition, have the problem of damage due to denting, shipment, and the like. Furthermore, a metal door has the ornamental appearance of a metal door, whereas molded doors can be configured to varying exterior appearances, and treated by surface coating or the pigmentation of the plastic to provide a wide variety of exterior effects. In addition, a molded door is substantially impervious to pitting, rotting, denting, warping, or marring by the elements such as salt spray, salt employed in snow removal, and the like.

An inherent problem in trying to make a molded plastic door is that there must be some form of reinforcement with plastic doors. Likewise, to successfully create a molded plastic door, at least two molded portions must be attached to each other in such a manner as to create various cavities therebetweenwith assured dimensional stability. None of the patents of the prior art shows a combination door molded of two halves, providing for relative movement within those two halves, providing adequate insulation, providing sufficient reinforcements to form a dimensionally stable molded plastic door, and accommodating both a screen and a storm window, and having such screen or storm window easily removable from the door.

Another inherent problem with storm doors is that they must deal with extreme temperature differentials. Such temperature differentials are not a function of ambient temperature, but rather the exterior temperature, and interior temperature of the house. For example, the temperature outdoors, in Minneapolis, can be as low as 15 degrees below zero, and yet with the heat of the mid-day sun, the dead air space between the storm door and the housedoor can be 72 degrees Farenheit or higher. With a molded door, or even a metal door for that matter, provision must be made to accommodate the expansion of the interior portion, and the contraction of the exterior portion. Even in a two piece door with a front and rear portion, in which both components are substantially of the same cross-section and size, the differential of expansion can be $\frac{1}{4}$ to $\frac{1}{2}$ inch along the width of the door, and $\frac{1}{2}$ to 1 inch in the height. This will cause warpage to an extended degree if not accommodated by appropriate design construction.

Finally, damage can occur in transit to the window portion, or the screen portion, and the easy removability of the same for purposes of replacement, or even for cleaning, has not been addressed by the prior art.

SUMMARY OF THE INVENTION

The present invention relates to a combination storm and screen self-storing door formed from a totally integral molded outer frame and a totally integral molded inner frame. Preferably, but not essentially, both frames are composed of a blown or porous insulative type plastic material. The outer frame has the configuration of the entire door including an open upper portion. Likewise, the inner frame also has the corresponding entire configuration of the door complimentary to the outer frame and also includes an open upper portion. The two frames are disposed in sandwiching relationship to each other, and thereby defining a storage cavity at the lower portion of the door. A storm window and screen are each slidingly positioned within the door to be lowered within the storage cavity when not in use and raised to the open upper portions when in use. To provide a door formed of molded plastic frames, a necessary reinforcement of the structure must also be provided. Sandwiched in supporting relationship therein is a plurality of reinforcement beams positioned on opposed lateral sides and top and bottom of the door. A portion of each reinforcement beam is configured to meshingly wedge between a pair of protruding prongs, one prong being formed on each of the opposed frames, whereby a particularly strong reinforcing structure is produced. The storm window has a gasket which is disposed in air tight engagement with the outer frame whereby the air space formed between adjacent frames is protected from the outside weather. Additionally, the periphery of the door is provided with numerous weather strips to improve the insulation qualities of the door. Also, the upper open portion of the inner frame allows for the screen and storm windows to be removed from inside the open upper portion without having to disassemble the door or panels thereof. Furthermore, the storm window is provided with locks comprising spring loaded locks which will prevent an excessive drop of the window when inadvertently released. An expansion joint is provided where the two members are secured to accommodate the differential in expansion and contraction due to temperature extremes. The opening on the inner side for the window and screen is substantially the same size as the window and the screen to provide for their removal.

Accordingly, it is a principal object of the present invention to provide a combination storm and screen door with self storing features. The same is preferably formed of a structural foam material in two pieces, and thereafter sandwiched together.

A related object of the present invention is to provide a combination storm and screen door formed of a structural foam material in two pieces which is provided with sufficient reinforcement to have dimensional stability in a durable structure. In addition, an expansion joint is provided where the two pieces are joined to accommodate substantial differences in the expansion and contraction of the two halves due to temperature extremes on the inside and the outside of the door.

A further object of the present invention is to provide an air gap or space between sandwiched pieces which is sufficiently protected from the outside weather and thereby providing added insulation for the door.

Another object of the present invention is to provide a door with weather stripping capable of excellent insulation around the periphery of the door.

Still another object of the present invention is to provide a door in which the screen and storm window can be conveniently removed without rearranging the structure of the existing door.

Yet another object of the present invention is to provide safety features to prevent excessive drop of the storm window when inadvertently released. A more specific object of the invention looks to a locking arrangement for the storm window which permits removal easily by retracting the lock on one side and then on the other side for removal with one hand.

Another more detailed object of the present invention is to provide integrally molded prong portions of the frames which overlap each other and provide for great strength, for dimensional stability for encasement of reinforcement beams, and for additional mounting support for screws and the like which are used to secure the hinges in place.

A further object of the present invention is to provide a molded combination door in which provision is made to prevent air leakage from the outside.

Still another object of the present invention is to provide a combination storm and screen door which can be formed when molded, with a wide variety of exterior decorative features optionally including a wood grain, thus making it a more attractive door, when installed.

A further object of the present invention is to provide a substructure framing support optimally along the sides, bottom, top, or various combinations thereof encased between molded structural members in a manner in which rust and deterioration will be minimized, and warp resistance maximized.

DESCRIPTION OF THE DRAWINGS

Further objects and advantages of the present invention will become apparent as the following description proceeds, taken in conjunction with the accompanying drawings in which:

FIG. 5 is a frontal elevation, partially broken, view of the storm window.

FIG. 6 is an enlarged partially broken view of the screen portion of the door.

FIG. 7 is a fragmentary enlarged view of the corner of the window having the spring lock.

FIG. 8 is a fragmentary cross-sectional view, partially broken away, of the window taken along section line 8—8 of FIG. 7.

FIG. 9 is a fragmentary cross-sectional view of the screen taken along section lines 9—9 of FIG. 6.

FIG. 15 is a perspective partially broken view of a modified alternative door construction.

FIG. 16 is a partially exploded perspective view of the overlapping portions of the door, comparable to that shown in FIG. 2, but illustrating the expansion joint.

FIGS. 17 and 18 are taken from vantage points 17, 18 of FIG. 15 in enlarged scale showing, in exaggerated form in FIG. 17, how the thermal differential of expansion and contraction in an amount of 87° can cause a distortion of the door.

FIG. 19 is a front elevation showing the interior portion with the storm window in position about to be removed.

FIG. 20 is a sequential view after FIG. 19 showing the upper portion of the storm window, and how the hand grasps the same.

FIG. 21 is a perspective view sequential to FIGS. 19 and 20 showing the actual removal of the storm window with the locks retracted.

FIG. 22 is an enlarged partially broken view of the upper left hand corner of the storm window.

FIG. 23 is a view similar to that of FIG. 22, but showing the storm window latch in its retracted configuration.

FIG. 24 is a transverse sectional view of the storm window latch taken along section line 24—24 of FIG. 22 in enlarged scale.

FIG. 25 is yet a further transverse sectional view of the latching mechanism for the storm window taken along 25—25 of FIG. 22 is enlarged section.

FIG. 26 is a further enlarged sectional longitudinal broken view taken along section line 26—26 of FIG. 23 illustrating the detent engagement of the latch.

FIG. 27 is an interior partially broken perspective view showing the relationship between the screen and the bug strip.

FIG. 28 is taken along section line 28—28 of FIG. 27 in enlarged scale further showing the bug strip and divider construction.

FIG. 29 is taken along section line 29—29 of FIG. 28 further showing the configuration of the bug strip and divider when the screen is in position.

FIG. 30 is yet another view taken along section line 30—30 of FIG. 28, showing the bug strip when the screen is not in place.

DESCRIPTION OF THE FIRST EMBODIMENT

Figure 1:
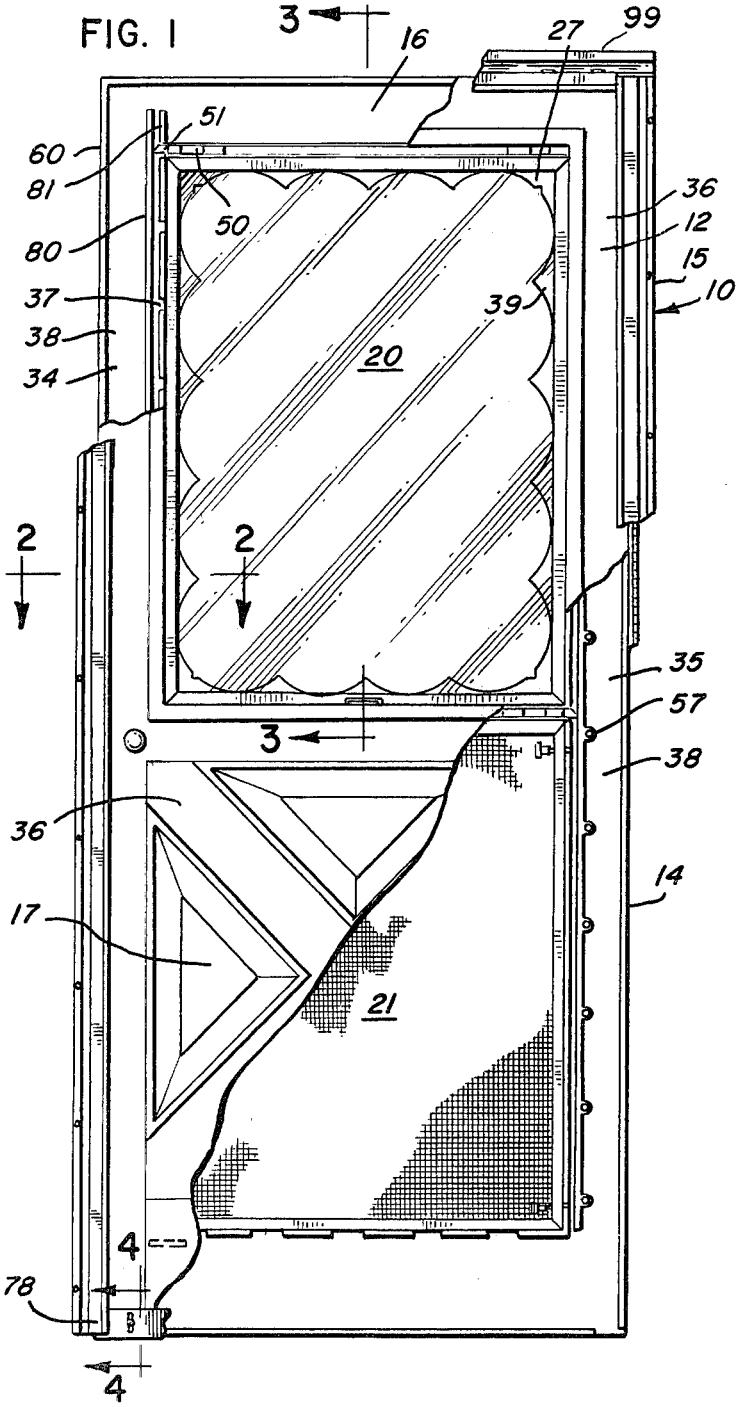
FIG. 1 is a partially broken front elevation view of the subject door.

As shown in FIG. 1, the present invention relates to a combination door, generally indicated as 10, comprising an outer frame 38 and an inner frame 36. The inner frame 36 preferably being a totally integral molded plastic frame of a rectangular configuration, includes an inside half 12. Likewise, outer half 11, which also is preferably integral molded plastic frame of a rectangular configuration, includes outside half 11. The upper portion of the door is generally labeled 15 while the lower portion of the door is generally labeled 14. The lower door portion 14 provides storage for a screen 21 and a window 20. The upper door portion 15 is adapted to have an opening 22 for the screen 21 and the window 20. This opening 22 is defined by the first open upper portion 18 of outer frame 38 and a correspondingly aligned second open upper portion 19 of inner frame 36. In other words, when the screen or window is not in use, it is stored in the lower portion 14, whereas when one or the other is in use, it is disposed in the opening 22 of the upper door portion 15. As also can be seen from FIG. 1, the combination storm and screen door 10 is provided with an attractive exterior, generally indicated as 17, simulating a wooden door. As can also be seen from FIG. 1, part of the inner frame 36 has been cut away to show the screen 21 in its stored disposition. Likewise, the window 20 can be seen in its "in use" disposition. The cutaways of the inner frame 36 also makes visible the outer frame 38. Spring locks 50 are mounted to the window and lockingly engage a number of fixed positions so as to regulate the air flow passing through the door 10. The spring locks 50 can clearly be seen in FIG. 13 lockingly engaging the lowermost notches so as to completely cut off any air flow. Screen 21 is provided with oppositely disposed plungers 94 and 95 which likewise secures the screen 21 in a fixed position when in use. The structural details of the specific construction of the screen 21 and the window 20 will become more evident upon a detailed description to be provided hereinafter in the description of FIGS. 5 and 6. Also visible in FIG. 1 is the outer frame skirt 39 which has a scalloped configuration. This outer frame skirt 39 prevents the screen 21 and window 20 from being removed from the outside. On the other hand, the screen 21 and the window 20 can be removed from their encasement by slipping them out of the opening of the inner half 12, without having to disassemble any part of the door structure. As shown in FIG. 21, this can be accomplished by raising the window 20′ or the screen 21′ to the middle of opening and lifting out top edge.

Figure 3:
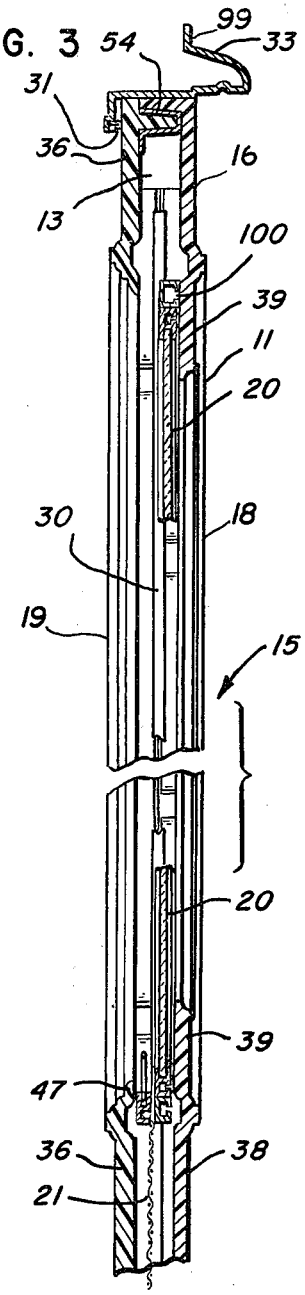
FIG. 3 is a fragmentary enlarged transverse sectional view taken along section line 3—3 of FIG. 1.
Figure 2:
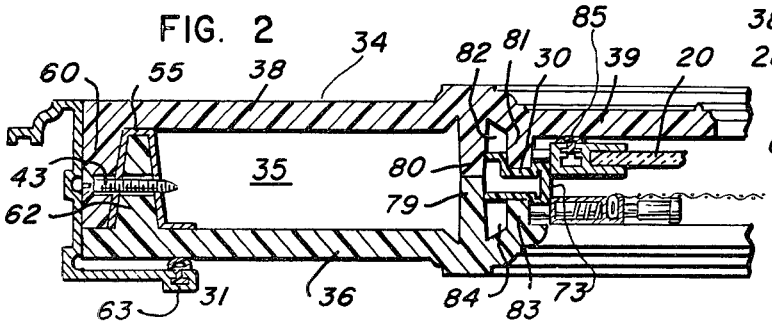
FIG. 2 is a fragmentary enlarged transverse sectional view taken along section line 2—2 of FIG. 1.
Figure 4:
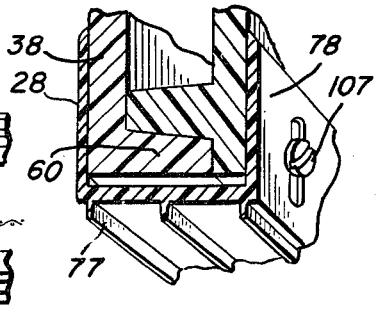
FIG. 4 is a fragmentary enlarged transverse sectional view taken along section line 4—4 of FIG. 1.
Figure 14:
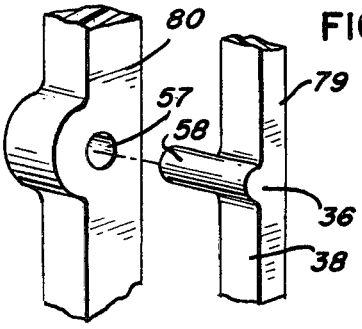
FIG. 14 is a fragmentary cut-away that is enlarged to show the means in which the frames are aligned relative to each other.
Figure 11:
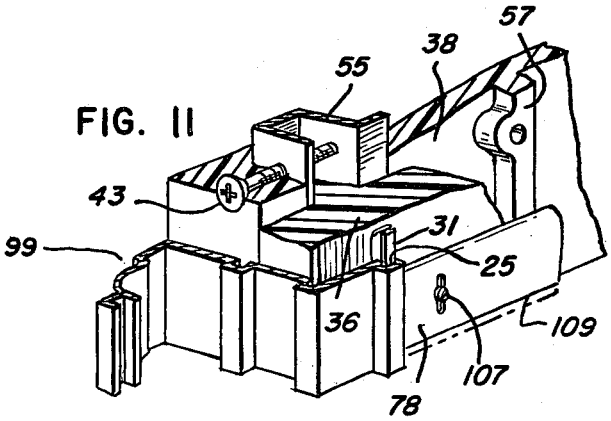
FIG. 11 is a fragmentary enlarged view of the lower corner of the door showing the reinforcement and weather strip.

FIG. 2 is a cross-sectional view of the interconnection of the outer frame 38 with the inner frame 36. The interconnection of the two frames, as shown in FIG. 2, is representative of the interconnection on each of the door's column members 34 and 35, top member 16, and bottom member 28. As illustrated in FIG. 2, integrally formed on each frame 36 and 38 is preferably a single prong. The inner prongs 62 terminate short of the ends of the outer prongs 60. The prong 60 on frame 38 is disposed to overlap the prong 62 on frame 36, with a portion of the side support beam 55 disposed therebetween, as will be described hereinafter. A plurality of screw fasteners 43 are disposed in elongated holes in the prongs 60 and 62 on the side opposite the hinged side and on the top of the door to permit floating joints. The center holes, may be normal size to provide a dimensionalized stable midpoint in the floating joint. The screws 43′ (see FIG. 16) which are employed have a tapered end portion which serves through heat, pressure and friction to pre-bore the hole, and then threads are adjacent the head to engage the plastic material. Also integrally formed in outer frame 38 and inner frame 36 are opposed ridges 80 and 79 respectively. FIGS. 3 and 4 show the means by which the frames 38 and 36 are interconnected at the top and bottom of the door 10 respectively. Alignment of the two frames 38 and 36 is enhanced by means of a plurality of female receptacles 57 and male connectors 58, as shown in FIGS. 1, 14 and 11. As shown in FIG. 11, each female receptacle is integrally molded into the ouer frame 38. Each male connector 58 is integrally molded into the inner frame 36 and aligned to engage and protrude within a corresponding female receptacle 57. Preferably a plurality of these connector arrangements are used along the lateral sides of the frames 36 and 38 as shown in FIG. 1.

Figure 10:
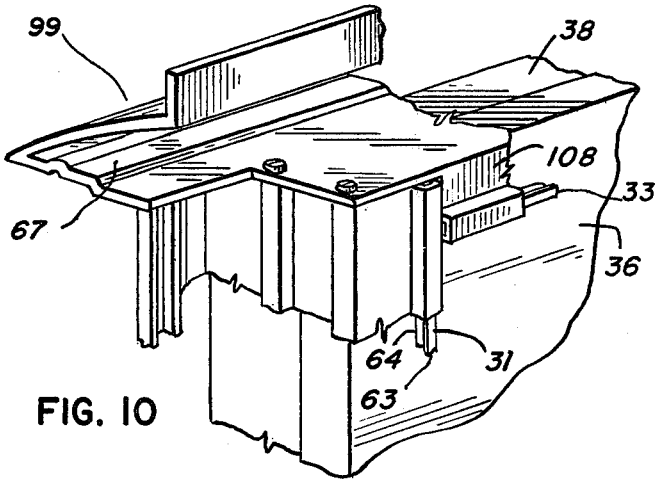
FIG. 10 is a fragmentary enlarged view of the corner of the door having the weather stripping.

To provide sealing around the door, weather stripping is inserted in the outer door frame 99, particularly as shown in FIGS. 10 and 11, thereby defining top weather stripping 33 and side weather stripping 31, 32. The weather stripping 31, 32, 33 is extruded having a T-head lock 63 and a side contact portion 64, which is elliptical and hollow and crushingly engages the sides of the storm door. The weather stripping 31, 32, 33 is inserted in an undercut 25 extruded in the outer door frame 99. No weather stripping is provided in the door itself to engage the outer door frame 99, but rather the weather stripping is in the outer door frame 99 to engage the door. Alternatively, interior weather stripping is provided for the storm window portion.

To provide air and storm sealing around the door, top weather strip 33 and side weather strips 31 and 32 are disposed around the periphery edges of the door, as shown in FIG. 1, FIG. 2, and FIG. 10. Top weather strip 33 is mounted on a depending flange on the outer door frame 99 adjacent the upper edge of the door. The depending flange comprises a contact portion 108 which engages, the entire length of the top of the door, and the outer door frame 99 surrounding the door 10, so as to provide further insulation. The top contact portion 108 is attached to one end of the extension portion 67. Weather sealing along the lateral edges of the door 10 is provided by oppositely disposed side weather strips 31 and 32. Weather strip 31 can clearly be seen in FIGS. 2, 10, and 11. Weather strip 31 includes a T-head lock portion 63 with a side hollow contact portion 64 disposed on its outermost longitudinal extremities. Therefore the contact portions 64 of weather strips 31 mounted in undercut 25 provide a storm weather sealing engagement along the lateral sides of door 10.

Figure 12:
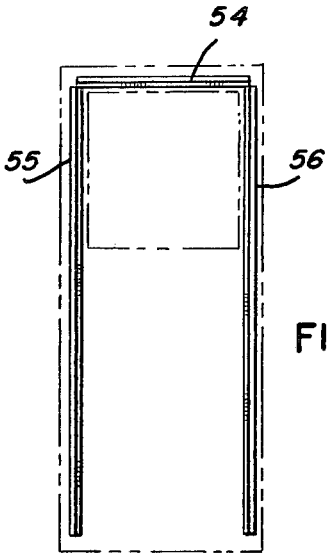
FIG. 12 is a front elevation view of the subject door showing the positioning of the reinforcement beams.

The door 10 is provided with a reinforcement structure, preferably made of steel, which is configured and dimensioned for a portion thereof to be wedged between frames 36 and 38. As shown in FIG. 12, the steel reinforcement structure comprises top reinforcement beam 54 disposed at the top of the door, and opposed side beams 55 and 56 positioned on opposite lateral sides of the door 10. Side reinforcement beam 55 in a cross-sectional view is clearly shown in FIG. 2 in its wedged relationship between the frames 36 and 38. Also, top reinforcement beam 54 in a cross-sectional view is shown in its wedged relationship with the frames 36 and 38 in FIG. 3. Therefore, it can be seen that a wrapped-around steel frame of the door's top, and two sides is provided between the molded structural members 36 and 38, and the steel is in substantially weather-tight retention between the frames so as to minimize rust and deterioration. Additionally, this steel frame secures the door against warpage.

As previously described in connection with FIG. 1, the window opening 22 is defined by the inside half 12 of inner frame 36 and the outside half 11 of outer frame 38, with the outside half 11 having a scalloped exterior, which extends inwardly in overlapping relationship to the opening of inner frame 36. Not only does this scallop portion, labeled as the outer frame skirt 39, provide a decorative appearance, but it also prevents the removal of the screen and window from the outside. Additionally, the outer frame skirt 39 overlaps the edge of the storm window 20 to the extent that, in combination with the gasket 85 on the window 20, the storm window 20 is further sealed against wind and air leakage. The overlapping relationship of the frame skirt 39 can clearly be seen in FIGS. 1, 2, and 3.

Figure 13:
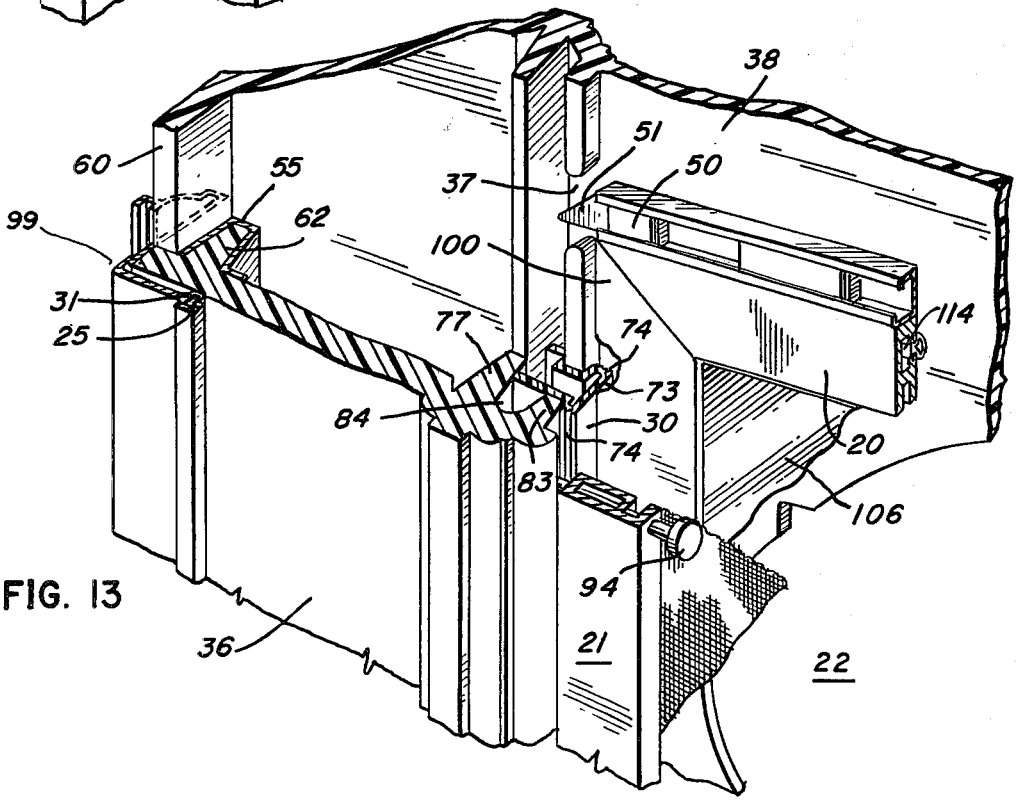
FIG. 13 is a fragmentary enlarged view of the window and screen engaging the frame.

Turning to FIGS. 5 and 6, it will be seen that storm window 20 and the screen 21 are substantially rectangular and, as can be seen in FIG. 3, can be overlappingly juxtaposed each on the other. Turning specifically to FIG. 5, it can be seen that the glass 106 of the storm window 20 is framed by means of a window frame 100 comprising opposed side frame members 103 and 104 and top and bottom frame members 101 and 102 respectively. Preferably, these frame members can be interconnected at their ends by the use of a plurality of support elbows 105, with one such support elbow 105 being positioned to form a right angle interconnection of opposed corners of adjacent, abutting frames. Additionally, as shown in FIG. 13, a cavity 114 can be formed inside of the window frame 100 so as to decrease the material required in forming such a frame. The attachment of the glass 106 to the frame 100 can clearly be seen in the cross-sectional view of FIG. 8. As can be seen in FIG. 6, the screen material 98 of the screen 21 is framed by means of screen frame 89, comprising opposed side frame members 93 and 92, and top and bottom frame members 90 and 91 respectively. As with the window frame 100, the screen frame 89 is held together at its corners by a plurality of support elbows 97. Screen material 98 itself, as shown in FIG. 9, is secured in a screen mount channel 71 by means of the screen mount 72, the latter normally being a rubber or other yieldable circular type member which is force-fitted into place and securing the same in the screen mount slot or channel 71.

Positioned on all four corners of the window 20 is a plurality of spring locks 50. These locks 50 have a safety feature so that, in the event the window is inadvertently dropped during raising or lowering, the locks on the upper corner of the window will be locked in position. The blown up view of one of the spring locks 50 is shown in FIG. 7. The spring lock 50 comprises locking tongue 51 integrally formed on one end of an elongated sliding portion 115. The tongue 51 has a beveled edge extending upwardly and outwardly relative to the lock's disposition in FIG. 7. This beveled edge allows for locking engagement of the tongue when the window is slipping downward, but prevents locking engagement when proceeding upward with the window 20. Centrally located on one side of the elongated sliding portion 115 is a finger recess 48 which can be utilized for unlocking the spring lock 50. Disposed on the opposite end of the elongated sliding portion 115 relatively to the locking tongue 51 is a spring 53, which provides sufficient pressure to push the locking tongue 51 into locking disposition. An upper window slide lock track 42 extends along the entire top of top frame member 101 and a lower window slide lock track 86 extends along the entire bottom of bottom frame member 102. These tracks 42 and 86 encase the elongated sliding portion 115 of each sliding lock 50 so that its movement is horizontally along the longitudinal dimensions of the tracks. When the locking tongue 51 is initially disengaged, and the window lowered slightly, the spring 53 urges the tongue 51 outwardly in a manner to push the locking tongue 51 into sliding relationship relative to the side frame member 103.

As shown in FIG. 2, opposed divider slide locking ribs 81 and 83 are disposed along the longitudinal dimensions of the columns members of the door frames 38 and 36 respectively. This longitudinal alignment of these ribs can clearly be seen in FIG. 1. Disposed in spaced apart relationship to each other, is a plurality of notches 37 integrally formed within each of these ribs in the upper portion 15 of the door 10. These notches 37 are configured and aligned to receive the locking tongues of the spring locks 50. When the window is in its stored position, it can be raised upward without the spring locks 50 locking the window 20 in place, due to the beveled edges of the tongues 51. There are no notches 37 on the lower portion 14 of the door for the spring locks 50 of the lower track 86 to engage until the window is in its maximum or final raised position. As seen in FIG. 13, when the window 20 reaches its maximum raised position, it is supported only by the tongues 51 of the two spring locks 50 in the lower track 86. The two tongues 51 of the two spring locks 50 in the upper track 42 are spaced apart from the lower edge of the corresponding notches 37 when the window is in its maximum raised position. This is accomplished by careful placement of the notches 37 and has the purpose of assuring that the window 20 is supported on its lower portions and not hung by its upper portions. The locks 50 of the lower track will automatically engage the corresponding notches 37 when raised to its maximum raised position so that the window will rest upon the tongues 51 of the locks 50 of the lower track 86. To lower the window 20, the locks 50 of the lower track must be manually disengaged, with the window 20 being dropped until the tongues 51 of the locks 50 of the upper track 42 hangingly engages the lower edges of the corresponding notches 37. Then, the locks 50 of the upper track 42 are disengaged, allowing the window to slide downward into its stored disposition. Should the window 20 now be dropped, the spring loaded feature of the locks 50 of the upper track 42 would result in these locks 50 lockingly engage the notches 37, and thereby preventing a further drop.

Additionally, as shown in FIG. 6, disposed on side frame members 93 and 92 of the screen 21 are two pairs of hand operated plungers 94 and 95. These plungers provide locking engagement with the frames 36 and 38 so that the screen can be positioned to close the opening 22. Also provided is a screen handle 96, which is utilized to initiate raising the screen from a stored disposition.

As described hereinafter, the frames 36 and 38 are secured to each other by, in part, using prongs 60 and 62 along the lateral sides, bottom and top of the frames. The overlapping relationship of these prongs which are integrally molded to the frames produces a particularly thickened section of plastic for threading the screw fasteners 42, on the hinged side and bottom of the door, which are used to lock the corresponding prongs of opposed frames in meshed relationship. The outer screw holes 120, 121, 122 as shown in FIG. 16, for the screw fasteners 43' are elongated so that they act as expansion joints on the side opposite the hinged side and on the top of the door. These prongs provide additional dimensional stability, means for sandwiching the two halves together, and more particularly creates a thickened section of plastic for mounting hinges by which the door can be attached to the supporting structure. Although not shown in the drawings, a closure mount may be provided, and an upper chain mount may also be provided so that both an automatic door closure and a safety chain can be secured to the door. Additionally, the decorative plates in the center and top of the door add materials for better screw holding power.

The door 10 is provided with numerous arrangements that render the door air and insulating tight. As can be seen from FIG. 2, and more specifically, FIG. 13, the window 20 spaced apart relationship to the screen 21 is maintained by divider slide 30. The outer ridge 80 and the divider slide outer locking rib 81 defines a divider slide outer slot 82. Likewise, the outer ridge 79 and the divider slide interlocking rib 83 defines a divider slide inner slot 84. The two divider slide slots 82 and 84 are aligned to receive one end of the divider slide 30. The divider slide 30 has an elongated portion 73 disposed between the locking tongues 51 of the window 20 and the plungers 94 and 95 of the screen 21. As shown in FIG. 8, a gasket 85 is mounted around the entire window frame 100 on the side adjacent the outer frame 38. As can be seen in FIG. 2, the compression caused by the elongated portion 73 forms a relatively air tight engagement of the gasket 85 against the outer frame skirt 39. Additionally, this arrangement is improved upon by having a plurality of fin-like runners 74 running along the length of the divider slide 30 in the area of contact. These fin-like runners 74 provide sufficient pressure to maintain the compression of the gasket, while providing sufficient sliding contact to allow the window and screen to be raised and lowered without the user feeling the full weight of the window 20 while raising and lowering the same. The outer ridge 80 and the divider slide outer locking rib 81 in their longitudinal disposition along the columns of frame 38 can be more clearly seen in FIG. 1. Encasing both frames 38 and 36 at the bottom of the door is retainer 78, such retainer 78 having a U-shaped cross-sectional configuration. This retainer 78 is secured to the door by a plurality of screws. Positioned along the longitudinal dimensions of the bottom of retainer 78 are a plurality of protruding runners 77. These runners 77 create an air sealing engagement with the floor situated under the bottom of the door 10.

As partially described previously, the divider slide 30 has positioned thereon a plurality of fin-like runners 74. The divider slide 30 holds the window in compressed relationship to the outer frame 38 so as to create tighter tolerances relative to the decorative scallop area for air tight fitting. To implement this air tight fitting, a small gasket can be placed on the frame 38, thus insuring an air-tight fit. The spring locks of the window 20 are mainly provided to prevent inadvertent dropping thereof. Dropping of the window 20 would result in the tongues 51 engaging one of the notches 37, preventing the full fall of the window. However, with the screen, its weight is such that the mere compression of its plungers 94 and 95 against the divider slide 30 prevents an inadvertent drop. Normally, it has been found that only one locking position for the spring loaded operated plungers 94 and 95 is necessary, with those locking positions being disposed in the screen's full up position.

Particularly important with the present door 10, is that it has such thermal properties as to enable the building of an air pocket. As can clearly be seen in FIGS. 2 and 3, the window is placed against the outer frame 38, and therefore rides internally against the outside half of the door. The location of the window as being adjacent the outside panel or frame of the door enables the development of the necessary air pocket which creates desirable insulation and thermal properties.

In FIG. 2, the outer frame 38 is shown having integrally formed thereon, prong 60. Inner frame 36 has one prong 62 integrally formed thereon. Each of these elongated prongs, whether positioned on outer frame 38 or on inner frame 36, extends around the entire periphery of the frames. A longitudinal portion of side reinforcement beam 55 is correspondingly configured and dimensioned to be wedged between adjacent prongs 62 and 60. Correspondingly, the reinforcement beam 56 on the opposite lateral side is disposed in partial meshed encasement between prong 60 on one side and prong 62 on the other side. The prongs of the oppositely disposed frames 38 and 36 are maintained in their immediately adjacent relationship by screw fasteners 43 disposed in traverse relationship to the prongs. This overlapping meshing relationship of the prongs with a portion of the reinforcement beam disposed therebetween is carried out on both lateral sides, top or bottom, or combinations thereof, of the door in the same manner as described above. By virtue of this structure, a reinforced molded door of foam material is developed which provides particularly good dimensional stability and prevention of warping.

As previously described, a door has been developed which has many features leading to a well insulated door. In summary, the door is preferably formed of a foam material, such as plastic. However, the door does not have to be foam material. Also, various weather strips around the door have been appropriately mounted. The door is formed of two pieces joined by an expansion joint which insures dimensional stability due to temperature differentials between the two pieces.

Also as has previously been described, the divider slide 30 is situated to press the gasket 85 of window 20 into air-tight engagement of outer frame 38. It is very important that the window be adjacent and in air-tight contact with the outer frame 38 instead of the inner frame 36. This allows for the formation of an air space, to be described hereinafter. The air space, generally indicated as 68, can partially be seen in FIG. 2. Normally there is an air space 68 created between adjacent frames 38 and 36 over a majority of the area encompassed by such frames. If the window had been positioned adjacent to the inner frame, then there would exist an opening between the outside and the air space 68 preventing proper insulation utilizing this air space. Therefore, by positioning the window 20 against the outer frame 38, the air gap will aid the insulation of the door, along with the above described other features.

Both the window 20 and screen 21 are removable from the door 10 through the second open upper portion 19 of the inner frame 36, without the removal of panels of the door. Due to the skirt 39 of the outer frame 38, neither the window 20 or the screen 21 can be removed through the first open upper portion 18 of the outer frame 38. The window and screen may have different height dimensions, but the horizontal width dimension must be the same or slightly less than the width of the second open upper portion 19.

Second Embodiment

The second embodiment of the combination door 10' is shown in FIG. 15. For purposes of convenience in description, common reference numbers, and common construction appear in the majority of the description. Where certain elements are not described, in detail, such as the notches 37 utilized to support the storm window spring lock 50, the second embodiment contains all of the structure described in the first embodiment. More specifically, it will be noted that the second embodiment 10' has a simulated wood finish on its exterior, and comprises an outside half 11', and an inside half 12' as well as a lower door portion 14' and an upper door portion 15'. The outer frame skirt 39' is scalloped, as in the first embodiment.

In the second embodiment combination door 10', it will be noted in FIG. 16, the prongs 60' and 62' are essentially rectangular in cross-section, as distinguished from isosceles trapezoidal as shown in the first embodiment 10. The side reinforcement beam 55 is proportioned to slidingly receive the prong 60', and be overlapped by prong 62' for affixing by means of the screws 43'. The elongate mounting holes which constitute the expansion joints 120, 121, 122 as described with the first embodiment. In this embodiment they are shown as progressively longer or more elongate, particularly as seen in FIGS. 16 and 18.

Shown graphically in FIGS. 17, 18, is a comparison of the subject combination door 10' wherein the expansion joints are not used in the construction shown in FIG. 17, but expansion joints such as 120, 121, and 122 are shown in FIG. 18. Diagrammatically, a temperature differential between minus 15 F. on the outside, and 72 F. on the inside are shown. This arises particularly on a clear very cold day when the outside portion of the door is substantially the same as ambient, whereas the inner portion of the door, due to the radiant and direct heating of the sun as well as the warmth of the house inside, may take on a temperature similar to the inside of the house. Under these circumstances, distortion due to the expansion of the inner frame 36' as distinguished from the outer frame 38' will cause significant warpage both vertically and laterally.

The improved construction for removing the window 20' is best illustrated in FIGS. 19, 20, and 21. There it will be seen that the operator reaches upwardly, and moves the spring lock 50' into a locked central position. Thereafter, as shown in FIG. 20, the operator can reach down over the top of the window 20', and grasp the upper frame removing the same outwardly from the frame and inwardly toward the house as shown in FIG. 21. In FIG. 21 it will be observed that the width of the window 20' as defined by its outer frame 100', enclosing the glass 106', must be the same or less than the opening in order to be taken out from the inside.

The specifics of the spring lock 50' are best shown in FIGS. 22 and 23, where it will be seen that an inner wall defined by the flanking members of the fingerhole 48', engages a pair of locking dimples 125, 126, which are respectively the dimples for locking in the lock position, or the retract position. The lock position is shown in FIG. 22, whereas the retract position is shown in FIG. 23.

The screen 21' is removed in substantially the same fashion with the second embodiment 10' as the original embodiment 10. This is shown in FIG. 27, where the additional feature of the bug strip 130 is illustrated. The bug strip 130 is an extension to the divider slide 30', and as noted in FIG. 30 extends outwardly in the normal configuration, but as shown in FIG. 29, overlaps the frame of the screen 21'. The screen hand operated plunger 94' terminates in an inner pin, and the same slides upwardly and downwardly in the slot 84, as with the first embodiment 10.

Summarizing, the second embodiment utilizes a modification of the spring lock 50' which permits unlocking the upper two members when the window is at its upper configuration so that it can be readily removed inwardly. The thermal expansion differential between the outer and inner portion of the door is accommodated by expansion joints 120, which accommodate in a sliding relationship the tendency of the two different materials to expand and/or contract depending upon the heat content of each. The reinforcing beam 55', because it is engaged by the screw 43' in two locations, and because of its inherent stability, permits the outer frame 38' to migrate with respect to the inner frame 36' and the reverse, thereby achieving the dimensional stability as shown in FIG. 18, and overcoming the adverse configuration as shown in FIG. 17. The gasket 85' as shown in FIG. 24 has a fur-like exterior 131, which has an insulating wiping effect with the outer frame 38', 39'.

Although particular embodiments of the invention have been shown and described in full here, there is no intention to thereby limit the invention to the details of such embodiments. On the contrary, the invention is to cover all modifications, alternatives, embodiments, usages, and equivalents of a combination storm and screen door as fall within the spirit and scope of the invention, specification, and the appended claims.

What is claimed is:

1. A reinforced door comprising, an outer frame of the entire configuration of the door including a first open upper portion, an inner frame of the entire configuration of the door complimentary to the outer frame, including a second uninterrupted open upper portion larger than the outer frame open upper portion, a storage cavity at the lower portion of said door defined by said outer frame and said inner frame, at least one sliding panel slidingly positioned within the door to be lowered within said storage cavity when not in use and raised to said open upper portion when in use and having a width the same or less than the opening, said panel being secured within the door by retractable means which, when retracted permit said panel to be removed through the uninterrupted open section portion, a side reinforcement beam sandwiched between said outer frame and said inner frame along a lateral side of said door, an expansion joint for receiving fastening means to secure the side reinforcement beam sandwiched between said outer frame and said inner frame along a lateral side of said door to permit expansion and contraction of the outer and inner members to retain dimensional stability, whereby said door is structurally reinforced and dimensionally stable to permit all panels to be removed from the inside of the door, and to permit the door to resist warpage.

2. A reinforced door of claim 1, a top reinforcement beam sandwiched between said outer frame and said inner frame.

3. A reinforced door of claim 1, said outer frame having at least one elongated prong disposed along at least a major portion of the lateral sides of said door, said inner frame having at least one elongated prong disposed for an immediately adjacent relationship with said prong of said outer frame, each said side reinforcement beam partially disposed in meshed encasement between said prong of said outer frame and said prong of said inner frame, whereby said side reinforcement beams are sandwiched between said opposed frames.

4. A reinforced door of claim 1, said at least one sliding panel comprising a window or a screen.

5. A reinforced door of claim 3, a top reinforcement beam positioned at the top of said door between said outer frame and said inner frame, each of said prongs extending along at least a major portion of the top of said door, said top reinforcement beam partially disposed in meshed encasement between said prong of said inner frame and said prong of said outer frame.

6. A reinforced door of claim 4, each of said prongs extending around the entire periphery of said door.

7. A reinforced door of claim 6, said reinforcement beams composed of a warpage resistant rigid material.

8. An insulated door comprising, an outer frame of the entire configuration of the door including a first open upper portion, an inner frame of the entire configuration of the door complimentary to said outer frame including a second open upper portion, each said frame comprising a totally integral singly molded frame, at least one frame having a substantially perpendicularly disposed prong for overlapping engagement with the opposite frame, means for securing said inner frame to said outer frame to thereby define an air space between the frames which includes a storage cavity, reinforcing means between said prongs to provide for dimensional stability, an expansion joint comprising elongate support members for means provided to fasten said prongs together thereby permitting expansion and contraction of one frame relative to the other while insuring dimensional stability, a window slidingly positioned within the door to be lowered within said storage cavity or raised to said open upper portion, said window being larger than the outer frame open upper portion disposed in airtight engagement with said outer frame whereby protection of said air space from the outside weather provides better insulation and whereby dimensional stability of the door is insured while a member is contained therein.

9. An insulated door of claim 8, a top weather strip disposed in weather sealing engagement with the top of said door, a pair of opposed side weather strips disposed in weather sealing engagement with opposite lateral sides of said door.

10. An insulated door of claim 9, said top weather strip and said side weather strips each having an integrally formed T-head lock and contact portion, whereby said weather strips provide for a storm sealing engagement of each said contact portions with the structure surrounding said door.

11. An insulated door of claim 10, a retainer having a plurality of protruding runners disposed on the bottom of said door, whereby the bottom of said door is insulated from the weather.

12. An insulated door of claim 8, said window having a gasket disposed around the entire periphery thereof, whereby an airtight engagement is formed between said window and said outer frame.

13. An insulated door of claim 12, a screen positioned adjacent said inner frame, a pair of divider slides disposed between said window and said screen in pressure relationship to the same, one of said pair being disposed adjacent to each opposed lateral side of said open upper portions, whereby said divider portions provides compression to maintain said airtight engagement of said gasket of said window with said outer frame.

14. An insulated door of claim 13, said window having a lock disposed in each corner thereof, each said lock having a tongue portion, said divider slides disposed in pressure relationship with said tongue portions.

15. An insulated door of claim 14, said screen having a plunger disposed substantially in each corner thereof, said divider slides disposed in pressure relationship with said plungers.

16. An insulated door of claim 14, said tongue portion having a beveled edge extending downwardly and inwardly, said locks comprising spring loaded locks, whereby said spring loaded locks do not lockingly engage said frames when being raised but lockingly engage said frames when said window is being lowered.

17. An insulated door of claim 16, a plurality of spaced-apart notches formed within said outer frame adjacent the lateral walls of said first open upper portion, said notches dimensioned and aligned to receive said tongue portion of said locks, whereby said window can be variably positioned within said open upper portions and said tongues positioned on the top of said window can lockingly engage said notches when said window is inadvertently dropped.

18. A combination door with removable screen and window comprising, an outer frame of the entire configuration of the door including a first open upper portion, an inner frame of the entire configuration of the door complementary to said outer frame including a second uninterrupted open upper portion aligned with and larger than said first open upper portion, a storage cavity at the lower portion of said door defined by said outer frame and said inner frame, a screen and a storm window proportioned for raising and lowering in and out of the storage cavity and for removal through the second open upper portion, each of said screen and window having retractable extension members for locking the same in position, said frames having parallel opposed divider slides defining parallel pairs of divider slide slots adjacent each divider, each of said screen and storm window having a horizontal width dimension the same or less than the horizontal width dimension of said second open upper portion of said inner frame and the space between the opposed divider slides, whereby the screen or storm window is raised or lowered as guided by the extension members in their respective divider slides, and upon retraction of the same, either can be alternatively removed from the open upper portion.

19. A combination door of claim 18, said outer frame having a decorative skirt integrally formed thereon adjacent said first open upper portion and disposed in horizontal dimension limiting relationship to said first open upper portion, said frame skirt and said outer frame defining a first open upper portion having at least part of its vertical height dimensions less than the vertical height dimension of said sliding panel, whereby said sliding panel cannot be removed through said first open upper portion.

20. A combination door of claim 18, said window including a lock having a tongue portion mounted in each corner thereof, said screen having a plunger disposed substantially in each corner thereof, a pair of divider slides disposed between said window and said screen, one of said pair positioned adjacent to each opposed lateral side of said open upper portions, said pair of divider slides aligned for a pressure relationship on one side with said tongue portions of said locks and on the other side with said plungers, whereby said divider portions in combination with said locks and said plungers provide compression to maintain the position of said window and said screen in said door, while allowing the same to be dimensioned so as to be removable through said second open upper portion.

21. A combination door of claim 18, said at least one sliding panel comprising a window or a screen.

22. A combination door of claim 18, said frames each comprise a totally integral molded frame.

23. A combination door of claim 18, a top weather strip disposed in weather sealing engagement with the top of said door, a pair of opposed side weather strips disposed in weather sealing engagement with opposite lateral sides of said door.

24. A combination door of claim 18, a plurality of spaced-apart notches formed in said frames adjacent both lateral walls of said open upper portions, at least two safety spring load lock positioned on opposed lateral sides of said window and disposed in notch engaging relationship.

25. A combination door of claim 18, said outer frame having at least one elongated prong disposed along at least a major portion of the lateral sides of said door, said inner frame having at least one elongated prong disposed for an immediately adjacent relationship with said prong of said outer frame, each said side combination beam partially disposed in meshed encasement between said prong of said outer frame and said prong of said inner frame, whereby said side reinforcement beams are sandwiched between said opposed frames.

26. A combination door of claim 24, elongate holes being provided in said outer frame prongs to receive fastening means for securing said inner and outer frames together, whereby disparate expansion and contraction of said inner frame and outer frame are accommodated by an expansion joint.

27. In the combination door of claim 26, the holes in said outer frame prong at its mid-point being normally dimensioned to provide for uniform adjustment in opposite directions therefrom.

* * * * *